US011619009B2

(12) United States Patent
Kloskowski et al.

(10) Patent No.: US 11,619,009 B2
(45) Date of Patent: Apr. 4, 2023

(54) PREPEG WITH IMPROVED FLATNESS

(71) Applicant: Schoeller Technocell GmbH & Co. KG, Osnabruck (DE)

(72) Inventors: Michael Kloskowski, Bramsche (DE); Ingo Gronde, Bissendorf (DE)

(73) Assignee: SCHOELLER TECHNOCELL GMBH & CO. KG, Osnabruck (DE)

( * ) Notice: Subject to any disclaimer, the term of this patent is extended or adjusted under 35 U.S.C. 154(b) by 359 days.

(21) Appl. No.: 16/903,430

(22) Filed: Jun. 17, 2020

(65) Prior Publication Data

US 2020/0399835 A1 Dec. 24, 2020

(30) Foreign Application Priority Data

Jun. 18, 2019 (EP) ..... 19180856

(51) Int. Cl.

| | |
|---|---|
| ***D21H 27/28*** | (2006.01) |
| ***D21H 17/53*** | (2006.01) |
| ***D21H 17/06*** | (2006.01) |
| ***D21H 17/60*** | (2006.01) |
| ***D21H 19/54*** | (2006.01) |
| ***D21H 19/56*** | (2006.01) |

(52) U.S. Cl.

CPC ..... *D21H 27/28* (2013.01); *D21H 17/06* (2013.01); *D21H 17/53* (2013.01); *D21H 17/60* (2013.01); *D21H 19/54* (2013.01); *D21H 19/56* (2013.01)

(58) Field of Classification Search

None

See application file for complete search history.

(56) References Cited

U.S. PATENT DOCUMENTS

| | | | | |
|---|---|---|---|---|
| 5,851,684 | A * | 12/1998 | Matscheko | D21H 17/43 524/22 |
| 5,885,719 | A * | 3/1999 | Perrin | D21H 17/35 428/534 |
| 5,955,203 | A * | 9/1999 | Briggs | B32B 5/02 428/464 |
| 5,965,315 | A | 10/1999 | Fujii et al. | |
| 6,480,299 | B1 | 11/2002 | Drakopoulos et al. | |
| 6,706,372 | B2 | 3/2004 | Schulz et al. | |
| 7,587,304 | B2 | 9/2009 | Thoma | |
| 8,130,387 | B2 | 3/2012 | Fejfar | |
| 8,349,464 | B2 | 1/2013 | Wicher et al. | |
| 10,003,142 | B1 | 6/2018 | Lin | |
| 10,136,032 | B2 | 11/2018 | Schmitt et al. | |
| 10,261,456 | B2 | 4/2019 | Schenk et al. | |
| 10,265,986 | B2 | 4/2019 | Kuhne et al. | |
| 10,632,778 | B2 | 4/2020 | Martorana et al. | |
| 2004/0197591 | A1 | 10/2004 | Schnieder et al. | |
| 2006/0227352 | A1 | 10/2006 | Mamberer | |
| 2008/0229962 | A1 | 9/2008 | Shedd et al. | |
| 2016/0009114 | A1 | 1/2016 | Leifert et al. | |
| 2017/0305178 | A1 | 10/2017 | Kuhne et al. | |
| 2018/0154666 | A1 | 6/2018 | Schmidt et al. | |
| 2019/0263164 | A1 | 8/2019 | Martorana et al. | |

FOREIGN PATENT DOCUMENTS

| | | |
|---|---|---|
| DE | 3741368 | 12/1988 |
| EP | 0906832 | 4/1999 |
| EP | 2743091 | 6/2014 |
| JP | H07-96654 | 4/1995 |
| JP | 2002-292995 | 10/2002 |
| KR | 20180026827 | 3/2018 |
| WO | 1996/011301 | 4/1996 |
| WO | 1997/031036 | 8/1997 |
| WO | 2000/006392 | 2/2000 |
| WO | 2007/080377 | 7/2007 |
| WO | 2016/074671 | 9/2016 |
| WO | 2016/188976 | 12/2016 |
| WO | 2018/091179 | 5/2018 |
| WO | 2021209333 | 10/2021 |

OTHER PUBLICATIONS

European Search Report for EP 19180856.7 dated Jul. 30, 2019.
European Search Report from EP 20170041.6 dated Oct. 28, 2020.
International Search Report for PCT/EP2016/061630 dated Dec. 1, 2016.
International Search Report for PCT/EP2017/074240 dated Dec. 22, 2017. (English Translation).
International Search Report for PCT/EP2021/059286 dated Jun. 23, 2021.
Written Opinion of the International Searching Authority for PCT/EP2016/061630 dated Dec. 1, 2016. (German Language).
Written Opinion of the International Searching Authority for PCT/EP2017/074240 dated Dec. 22, 2017. (English Translation).

* cited by examiner

*Primary Examiner* — Dennis R Cordray

(74) *Attorney, Agent, or Firm* — Honigman LLP; Andrew N. Weber; Jonathan P. O'Brien

(57) ABSTRACT

Prepreg obtained from a decor base paper impregnated with a formaldehyde-free impregnating resin solution, whereby a hydrophobic coating is applied onto at least one side of the prepreg, and decorative film or decorative coating material containing the prepreg according to the invention.

14 Claims, No Drawings

PREPEG WITH IMPROVED FLATNESS

TECHNICAL FIELD OF THE INVENTION

The invention relates to prepregs for coating purposes and decor papers or decorative coating materials obtainable therefrom.

BACKGROUND OF THE INVENTION

Decorative coating materials, also known as decor papers or decor films, are preferably used for surface coating in furniture manufacturing and in interior design and fittings, in particular laminate flooring. Decor papers/decor films refer to synthetic resin-impregnated or resin-impregnated and surface-treated, printed or unprinted papers. Decor papers/decor films are glued or bonded to a substrate board.

Depending on the type of impregnation process, a distinction is made between decor papers/decor films with a paper core that is thoroughly impregnated with thermosetting resin and what are known as prepregs, whereby the paper is only partially or almost completely impregnated with resin dispersions and water-soluble polymers online in the paper machine or offline.

Urea-formaldehyde (UF) glues or polyvinyl acetate (PVAC) glues are usually used for gluing decor films onto wood-based materials such as chipboard or MDF boards.

In the case of laminates produced from prepregs, the decor film, an optionally printed prepreg with a layer of varnish, is pressed together with a substrate, for example a chipboard, using the glue and applying pressure at high temperature. This can be performed, for instance, by means of a short-cycle press or a laminating calendar.

The processing industry places high demands on the bonding and adhesion characteristics of the glued decor film. Thus, for example, the adhesion must be good immediately after the gluing process in order to prevent damage to the freshly laminated panel during further handling. Within only a few minutes to a few hours after the decor film has been glued on, the panels are often sent for further machining, for example sawing, milling and drilling, whereby the applied decor film may not peel or tear at the processing edges. Furthermore, the finished surfaces are often packaged for further transport. For packaging purposes, adhesive tapes are also affixed directly onto the finished decorative surface. These adhesive tapes must have sufficient adhesive strength; it must be possible to remove them after transport without leaving any residue and without damaging or detaching the glued decor film. Therefore, even after gluing, the decor film must display high plybond strength perpendicular to the decorative surface.

The decor film used for the above-mentioned coating materials is white or colored, with or without additional printing.

With regard to their technical and application features, the decor base papers used as starting materials must meet certain requirements. These include high opacity for better coverage of the substrate, uniform formation and grammage of the sheet for uniform resin absorption, high light resistance, high purity and uniformity of color for good reproducibility of the pattern to be printed, high wet strength for a smooth impregnation process, appropriate absorbency to achieve the required degree of resin saturation, dry strength, which is important for winding/rewinding operations in the paper machine and printing operations in the printing machine.

For purposes of creating a decorative surface, patterns can be printed on decorative prepregs. This is mostly done by implementing the rotogravure printing process whereby the printed image is transferred onto the paper by means of several gravure cylinders. The individual dots should be transferred completely and as intensively as possible onto the paper surface. Especially in decorative gravure printing, however, only a fraction of the screen dots present on the gravure cylinder are transferred onto the paper surface. This results in missing dots or voids. Often, the printing ink penetrates too deeply into the paper structure and consequently reduces the color intensity. A surface topography that is as smooth and homogeneous as possible and balanced ink absorption characteristics of the paper surface are essential for ensuring a good print image with few missing dots and high color intensity. Likewise, in digital printing processes too, such as inkjet printing, which are becoming increasingly common today, a surface topography that is as smooth and homogeneous as possible and balanced ink absorption characteristics of the paper surface are decisive for ensuring a good print image.

For this reason, the base papers used for prepregs are usually smoothed with what are known as soft calendars, sometimes also referred to as Janus calendars. This treatment can result in the crushing and compaction of the paper surface and can subsequently impair the resin absorption capacity.

The printing pattern and/or varnish are applied to one side of the prepreg whereby the prepreg is fixed to the printed and/or varnished side, which is also called the decorative or visible side. If the reverse of the decorative or visible side of the prepreg is exposed to moisture, as is the case during further processing and gluing, the expansion on the reverse and the fixed layer on the visible side results in curling (coiling) or the formation of bubbles and pockets on the prepreg, depending on the impregnating resin used. The prepreg is thus not flat.

This condition is particularly disadvantageous when it comes to processing operations in stack presses, short-cycle presses and other non-continuous processes, as bonding with aqueous urea-formaldehyde glues (UF glues) or polyvinyl acetate glues (PVAC glues) is impaired.

The decor film, an optionally printed prepreg with a layer of varnish, that is to be bonded is pressed together with a substrate, for example a chipboard, at high temperature. Pressing of the decor film without imperfections is no longer possible if, due to poor flatness, curling occurs at the edges of the prepreg prior to pressing.

The above-mentioned properties are essentially influenced by the impregnation of the decor base paper, i.e. by the type of impregnating agent used. If, for example, the usual formaldehyde-based resins are used as impregnating resins, the prepregs produced exhibit good flatness properties, whereas prepregs produced with formaldehyde-free impregnating resins display poor flatness properties.

The impregnating resin solutions usually used in the production of conventional decor papers for impregnating the decor base papers are resins based on urea, melamine or phenolic resins. The use of these resins leads to brittle products with poor tearing strength and printability. Greater care must be taken to ensure that the impregnating resin solutions used for impregnating decor base papers are free of substances that are hazardous to health, in particular formaldehyde. Furthermore, the components used should, to the greatest extent possible, be obtained from renewable raw materials.

DE 197 28 250 A1 describes the use of formaldehyde-free resins based on a styrene/acrylic acid ester copolymer for the production of non-yellowing prepregs. The disadvantage of this material is that it leads to a product with insufficient adhesion after bonding.

Formaldehyde-free impregnating resin solutions for impregnating decor base papers are also described in EP 0 648 248 A1 and EP 0 739 435 A1. These solutions preferably consist of a styrene-acrylic acid ester copolymer and polyvinyl alcohol. Paper impregnated with such an impregnating resin solution, however, can also be improved in terms of adhesion after bonding.

WO 2001/11139 A1 proposes a formaldehyde-free composition of a binder, an aqueous polymer dispersion and glyoxal, which enables the production of splitting resistant decor papers. However, paper impregnated with this composition cannot be bonded well.

WO 2009/000769 A1 describes a formaldehyde-free composition for impregnation consisting of a styrene-acrylic acid ester copolymer and a starch with a specific molecular weight distribution.

EP 2 537 682 B1 describes a formaldehyde-free composition for impregnation consisting of a styrene-acrylic acid ester copolymer with hydroxyalkyl (meth)acrylate monomer parts and a starch with a specific molecular weight distribution. This improves the plybond strength and adhesion of the prepreg after bonding. Such prepregs can, however, exhibit insufficient flatness, particularly during the printing, coating and bonding process, and can cause undesired crimping.

In order to reduce the problem of insufficient flatness during further processing, WO 2010/089086 A1 also proposes the application of aliphatic, polycarbonate-based anionic polyurethane dispersions on the reverse of impregnated decor papers intended for gluing. However, comparatively high application quantities of 5 g/m$^2$ and more are required on the reverse and flatness is improved only if the same polyurethane dispersion is applied on the front side at the same time. In addition, the properties during bonding of the prepreg deteriorate significantly when increasing quantities of a coating are applied.

None of the hitherto known prepregs, which contain formaldehyde-based thermosetting resins or formaldehyde-free acrylic resin dispersions, meet all the requirements, for instance health and environmental safety, good flatness during subsequent processing steps such as printing, varnishing and final bonding, and good adhesion to a wood-based panel after bonding.

Either resins containing formaldehyde with good flatness properties but undesirable from an ecological and health perspective are used, or prepregs based on formaldehyde-free resins have poor flatness and/or poor adhesion properties.

BRIEF SUMMARY OF THE INVENTION

The object of the invention is therefore to provide a formaldehyde-free prepreg with good flatness properties, which does not have the above-mentioned disadvantages, and which is characterized in particular after printing and/or varnishing by good flatness during gluing and simultaneously by good adhesion after gluing and laminating on a permanent substrate, for example a wood-based panel.

This objective is accomplished by a prepreg of a decor base paper impregnated with a formaldehyde-free impregnating resin solution, whereby a hydrophobic coating is applied onto at least one side of the prepreg.

Surprisingly, it was found that the application of a hydrophobic coating on at least one side of the prepreg leads to improved flatness or less bulging of the sheet edges or curling of the prepreg during further processing and that the prepreg simultaneously maintains good adhesion characteristics after gluing to a wood-based panel with the usual aqueous glues.

The object of the invention is further a decorative film or a decorative coating material containing the prepreg according to the invention.

DETAILED DESCRIPTION OF PREFERRED EMBODIMENTS

The hydrophobic layer (coating) according to the invention is present on at least one side of prepregs which contain a decor base paper impregnated with a formaldehyde-free impregnating resin.

Formaldehyde-free impregnating resins comprise, for example, starch and/or polyvinyl alcohol. The content of the formaldehyde-free impregnating resin in the prepreg can preferably be 10 to 35% by weight, but in particular 12 to 30% by weight, based on the grammage of the decor base paper.

In general, prepregs are decor base papers which are impregnated with one or more impregnating resins and printed after impregnation. Conventionally, decor papers are first printed, for example with a wood pattern, and then impregnated. In the context of the present invention, prepregs are decor base papers impregnated with formaldehyde-free impregnating resin.

The decor base papers to be impregnated are papers that have not undergone internal sizing or surface sizing. These papers consist mainly of cellulose, pigments, fillers and common additives. Common additives can be wet-strength agents, retention agents and fixatives. Decor base papers differ from conventional papers by the much higher filler or pigment content and the absence of the usual internal sizing or surface sizing.

The hydrophobic coating on at least one side of the prepreg according to the invention has the function of reducing water vapor permeability without impairing the ability of the prepreg to bond to a substrate. In addition, this coating also serves to reduce the penetration of moisture, for example of the aqueous sizing agent.

The prepreg usually has a decor side and a reverse side. The decor side is the visible or printed side of the prepreg that faces the viewer of the finished decorative laminate. The reverse side of the prepreg is the side that faces away from the viewer of the finished decorative laminate and that faces the substrate material, e.g. the wood-based panel, when the decorative laminate is glued onto the substrate material.

According to a preferred embodiment of the invention, the hydrophobic coating is applied on the reverse of the decorative side of the prepreg.

The coating liquid for maintaining the hydrophobic layer on at least one side of the prepreg can be provided as a dispersion. This dispersion can be a suspension or an emulsion. Consequently, the hydrophobic agent can be present in the dispersion as a solid or liquid (emulsified).

The weight of the applied hydrophobic coating can be 0.1 to 10 g/m$^2$ bd (bone dry), preferably 0.3 to 5 g/m$^2$ bd, particularly preferably 0.4 to 2.5 g/m$^2$ bd, very particularly preferably 0.5 to 1.5 g/m$^2$ bd, in each case based on the weight of the prepreg.

The hydrophobic coating according to the invention preferably contains an organic hydrophobic agent, the content whereof is 20 to 100% by weight, relative to the total weight of the bone dry (bd) hydrophobic coating, in particular 40 to 90% by weight, and particularly preferably 50 to 70% by weight.

Waxes can be used as organic hydrophobic agents. Waxes in the context of the present invention are on the one hand mixtures of esters of long-chain monohydric alcohols with long-chain fatty acids. On the other hand, waxes according to the invention also include mixtures of substances of wax-like consistency which melt between 40° C. and 350° C. and to which the aforementioned chemical definition does not apply or, if at all, applies only partially. According to the invention, long-chain monohydric alcohols and long-chain fatty acids refer to those monohydric alcohols and fatty acids which have aliphatic chains of 12 to 38 carbon atoms.

Animal, vegetable and synthetic waxes can be used as waxes. Preferred embodiments include chemically modified natural waxes, also known as semi-synthetic waxes, e.g. ester waxes (reaction products of long-chain wax acids and monohydric fatty or wax alcohols), amides of fatty and wax acids, such as ethylene (bis)stearamide or ethylene distearylamide, stearic acid amide, behenic acid amide, erucic acid amide, oleic acid amide, acid waxes, Lanette waxes, ketone waxes, ether waxes, soy wax, castor wax, rapeseed wax, and fully synthetic waxes, e.g. polyolefin waxes, such as polyethylene waxes, high-density polyethylene (HDPE) waxes and polypropylene waxes, olefin copolymer waxes, such as ethylene-vinyl acetate (EVA) waxes, polyester waxes and polyethylene glycol (PEG) waxes, as well as PTFE waxes and fluoro waxes and mixtures thereof. According to the invention, polyethylene (PE) waxes are particularly preferred, especially high-density polyethylene (HDPE) waxes, paraffin waxes or mixtures thereof. The mixtures of waxes may be mixtures of two or more waxes of the same type or of different types. A mixture of waxes of the same type refers to, for example, a mixture of two waxes, both of which are PE waxes. A mixture of waxes of different types refers to, for example, a mixture of a paraffin wax and a PE wax.

In addition to the hydrophobic agent, the coating liquid may contain other auxiliary substances, such as wetting agents, emulsifiers, binders and thickeners. In addition to the hydrophobic agent, the coating liquid particularly preferably contains acrylate-polymer-based or methacrylate-polymer-based or copolymer-based binders, which (meth)acrylic acid ester as comonomer.

The hydrophobic coating can be applied to the reverse of a decor base paper before or after impregnation of the decor base paper. Application of the hydrophobic coating after impregnation of the decor base paper is preferred.

The formaldehyde-free impregnating resin for the production of the prepreg is preferably a mixture of a water-soluble polymer and a polymer latex. The ratio of water-soluble polymer/polymer latex in the impregnating resin solution is preferably 80/20 to 20/80. However, a ratio of 45/55 to 65/35 and, in particular, 50/50 to 60/40 is preferred, in each case based on the weight of the impregnating resin (bd).

The water-soluble polymers used include starch, starch derivatives or nanoscale starch particles, in particular starch dextrin, which can be produced from renewable raw materials. According to a further embodiment of the invention, polyvinyl alcohol can also be used.

The polymer latex can preferably be a styrene copolymer such as a styrene-acrylic acid ester copolymer, a styrene-vinyl acetate copolymer, a styrene-butadiene or a styrene-maleic acid copolymer. However, mixtures of these copolymers can also be used.

In a special embodiment of the invention, the formaldehyde-free impregnating resin used to produce the prepreg according to the invention contains as polymer latex a styrene-acrylic acid ester copolymer, preferably a styrene-butyl acrylate copolymer.

The impregnating resin solution may contain pigments and/or fillers. The quantity of the pigment and/or filler may be 1 to 30% by weight, in particular 2 to 20% by weight. The quantity indicated refers to the weight of the binder (bd). The term binder in this context refers to the mixture containing the polymer latex and the water-soluble polymer.

The impregnating resin solution used to produce the prepregs according to the invention can have a total solids content, based on dry matter, of 9 to 40% by weight, preferably 20 to 35% by weight, and particularly preferably 26 to 30% by weight.

The impregnated decor base paper coated according to the invention can have a high pigment or filler content. The filler content in the decor base paper may be up to 55% by weight, in particular 8 to 45% by weight, based on the grammage. Suitable pigments and fillers are, for example, titanium dioxide, talc, zinc sulfide, kaolin, aluminum oxide, calcium carbonate, corundum, aluminum and magnesium silicates or mixtures thereof.

Softwood pulps (long-fiber pulps) and/or hardwood pulps (short-fiber pulps) may be used to produce the decor base papers. Cotton fibers and mixtures thereof with the aforementioned pulp types can also be used. For example, a mixture of softwood/hardwood pulps in a weight ratio of 10:90 to 90:10, in particular 20:80 to 80:20, is particularly preferred. However, the use of 100% hardwood pulp by weight has also proved to be advantageous. The quantities stated are based on the pulp weight (bd).

Preferably, the pulp mixture may contain a proportion of cationically modified pulp fibers of at least 5% by weight, based on the weight of the pulp mixture. A proportion of 10 to 50% by weight, in particular 10 to 20% by weight, of the cationically modified pulp in the pulp mixture has proved to be particularly advantageous. The cationic modification of the pulp fibers can be achieved by reaction of the fibers with an epichlorohydrin resin and a tertiary amine or by reaction with quaternary ammonium chlorides such as chlorohydroxypropyl trimethyl ammonium chloride or glycidyl trimethyl ammonium chloride. Cationically modified pulps and their production are known, for example, from DAS PAPIER, Issue 12 (1980), pp. 575-579.

The decor base papers can be manufactured on a Fourdrinier or Yankee paper machine (cylinder paper machine). For this purpose, the pulp mixture can be ground at a stock consistency of 2 to 5% by weight up to a freeness of 10 to 45° SR. In a mixing chest, fillers such as titanium dioxide and talc and wet-strength agents can be added and mixed thoroughly with the pulp mixture. The thick stock thus obtained can be diluted up to a stock consistency of about 1% and, if necessary, other auxiliary substances such as retention agents, defoamers, aluminum sulfate and the other auxiliaries mentioned earlier can be added. The resulting thin stock is fed to the wire section via the paper machine headbox. A fiber mat is formed and, after dewatering, the decor base paper is obtained and subsequently dried. The grammage of the papers produced may be 15 to 300 g/m$^2$. However, decor base papers with a grammage of 40 to 100 g/m$^2$ are particularly suitable.

The impregnating resin solution can be applied to the decor base paper (impregnation) in the paper machine or offline by spraying, immersion or coating by means of a roller or squeegee. Application via size presses or film presses is particularly preferred.

The impregnated papers are dried in the usual manner by means of IR dryers or roller dryers in a temperature range from 120 to 180° C. to a residual moisture content of 2 to 6%.

After drying, the impregnated papers (prepregs) can still be printed and coated and subsequently laminated onto different substrates, for example chipboard or fiberboard, using conventional methods.

The hydrophobic coating on the reverse of the impregnated paper can be applied in the paper machine or offline using all the conventional application methods that are common in the paper industry, for instance spraying, immersion or various coating techniques such as coating by means of a roller (e.g. kiss coater), coating by means of a squeegee or doctor blade, or also curtain coating. Application by a film press or anilox roller with a pressurized chamber doctor blade system is particularly preferred.

The impregnated papers that are coated on the reverse are dried in the usual manner by means of hot-air convection dryers, IR dryers or roller dryers in a temperature range from 120 to 180° C. to a residual moisture content of 2 to 6%.

After drying, the coated prepregs can still be printed and coated and subsequently laminated onto different substrates, for example chipboard or fiberboard, using conventional methods.

The following examples and tests aim to provide a detailed explanation of the invention. Unless otherwise indicated, figures in percent by weight are in relation to the pulp weight. The quantity ratio refers to the mass or weight ratio.

EXAMPLES

(Comparative) Example V-1

A pulp suspension was prepared by grinding a pulp mixture consisting of 80% by weight eucalyptus pulp and 20% by weight pine sulfate pulp at a stock consistency of 5% up to a freeness of 33° SR (Schopper-Riegler). Subsequently, 1.8% by weight epichlorohydrin resin was added as a wet-strength agent. This pulp suspension was adjusted to a pH value of 6.5 with aluminum sulfate. A mixture of 30% by weight titanium dioxide and 5% by weight talc, 0.11% by weight of a retention agent and 0.03% by weight of a defoaming agent was subsequently added to the pulp suspension and a decor base paper with a grammage of 50 g/m$^2$ and an ash content of 23% by weight was produced. The weight data stated are based on the pulp weight (bd).

This base paper was impregnated on both sides in a size press with an aqueous resin solution having a solids content of 30% by weight and containing dextrin (EMDEX® B1102, Emsland-Stärke, Emlichheim, Germany) and styrene-butyl acrylate copolymer latex (Revacryl® X4340, Synthomer, Marl, Germany) in a ratio of 55:45. For this purpose, a 45% dextrin batch was first prepared and diluted with water to a concentration of 25% by weight. Subsequently, the corresponding amount of the 50% aqueous polymer dispersion was added and the resulting polymer solution was diluted with water to a solids content of 30% by weight and adjusted to pH 8.0 with caustic soda.

The impregnated paper was subsequently dried at a temperature of 120° C. to a residual moisture content of 2.5%. The coating weight of the impregnating resin solution after drying was 10 g/m$^2$.

The glass transition temperature $T_g$ of the latex (copolymer) Revacryl® X4340 used is 28° C.

(Invention) Example A-1

A wax-based dispersion was applied by means of a bar doctor blade (100 μm groove depth) onto the reverse of the impregnated base paper prepared according to Example V-1. After dilution, the applied aqueous dispersion has a solids content of 20% by weight. The wax-based dispersion is commercially available under the brand name Wükoseal® KIT (solids content of 40% by weight) from Münzing Chemie GmbH, Abstatt, Germany.

The paper coated on the reverse was subsequently dried at a temperature of 120° C. to a residual moisture content of 2.5%. The weight of the coating after drying was 1.5 g/m$^2$, whereby the weight of the wax in the dispersion was 0.5 g/m$^2$

(Invention) Example A-2

The prepreg is coated as in Example A-1. After dilution, however, the applied aqueous dispersion has a solids content of 15% by weight.

The paper coated on the reverse was subsequently dried at a temperature of 120° C. to a residual moisture content of 2.5%. The weight of the coating after drying was 1 g/m$^2$.

(Invention) Example A-3

A wax-based dispersion was applied by means of a bar doctor blade (300 μm groove depth) onto the reverse of the impregnated base paper prepared according to Example V-1. After dilution, the applied aqueous dispersion has a solids content of 25% by weight. The wax-based dispersion is commercially available under the brand name Wükoseal® KIT from Münzing Chemie GmbH, Abstatt, Germany.

The paper coated on the reverse was subsequently dried at a temperature of 120° C. to a residual moisture content of 2.5%. The weight of the coating after drying was 5 g/m$^2$.

(Invention) Example A-4

A wax-based dispersion was applied by means of a bar doctor blade (100 μm groove depth) onto the reverse of the impregnated base paper prepared according to Example V-1. After dilution, the applied aqueous dispersion has a solids content of 20% by weight. The wax-based dispersion is commercially available under the brand name Hydrowax 215 from Sasol, Hamburg, Germany.

The paper coated on the reverse was subsequently dried at a temperature of 120° C. to a residual moisture content of 2.5%. The weight of the coating after drying was 1.5 g/m$^2$.

(Comparative) Example V-2

A suspension was applied by means of a bar doctor blade (100 μm groove depth) onto the reverse of the impregnated base paper prepared according to Example V-1. After dilution, the applied aqueous suspension has a solids content of 50% by weight. The silane-based suspension is commercially available under the brand name Sitren 595 from Evonik Industries AG, Essen, Germany.

The paper coated on the reverse was subsequently dried at a temperature of 120° C. to a residual moisture content of 2.5%. The weight of the coating after drying was 1.5 g/m$^2$.

(Comparative) Example V-3

For purposes of comparison, a commercially available formaldehyde-based prepreg 9327060 from Kämmerer Spezialpapiere GmbH, Osnabrück, Germany, is used.

The test procedures are explained in the following.

Flatness: Curling Characteristics According to the Braun Method

A test specimen with the dimensions 10 cm×7 cm is placed such that its reverse is in contact with distilled water.

Upon contact, a stopwatch is started to read the time. The water temperature is 20-22° C. After 5 seconds, the test specimen is removed from the water surface. Using a pair of tweezers, the test specimen is pulled up along the narrow end (7 cm) and held downwards in a vertical position. The time is stopped when the two longitudinal sides of the test specimen touch each other.

Curling according to the Braun method is characterized by the time (in seconds) required for the two longitudinal sides of the specimen to touch each other after the specimen is removed from the water bath. The time reading after stopping the time must therefore be reduced by 5 seconds, namely the time that the test specimen has rested on the water surface. The result thus obtained represents the curling characteristics according to the Braun method.

Flatness: Water Value

A shallow tray with DIN A3 dimensions or larger is filled with distilled water. A test specimen with DIN A4 dimensions is placed such that its reverse is in contact with the water surface. Upon contact, a stopwatch is started to read the time. The water temperature is 20-22° C. The behavior of the edges of the test specimen over time is observed. The time is stopped as soon as the edges of the test specimen have exceeded the maximum point of curling or coiling and begin to unwind, i.e. the edges start moving back towards the water surface. The time reading thus obtained represents the water value.

Varnishing of the Prepreg

The prepreg samples are heated beforehand at 160° C. for 60 seconds. Subsequently, 10±1 g/m$^2$ of the acid-curing varnish system IV-49 from Plantagchemie, Detmold, Germany, are applied with a squeegee. The samples are dried horizontally in a drying oven at 160° C. for 45 seconds.

Lamination of the Prepreg

The varnished prepreg is applied to a chipboard using a laboratory laminating calendar. Commercially available chipboards (20 cm×20 cm) are used. A urea-formaldehyde resin glue solution (Kaurit Glue 122 from BASF, Ludwigshafen, Germany, powder dissolved in water with 50% solids content) is applied to one side of the chipboard with a squeegee; the weight of the glue coating (solids content) is 35±5 g/m$^2$. The varnished prepreg sheet is placed on the chipboard surface provided with the glue, whereby the varnished side of the prepreg sheet faces away from the chipboard and the sheet protrudes approximately 2 cm beyond the chipboard on all sides. Thereafter, the chipboard with the prepreg is passed through the laminating calendar, whereby the contact pressure is 80 N/mm, the temperature of the pressure roller is 180° C. and the feed rate is 2 m/min.

Adhesive Strength

The adhesion test is performed immediately after lamination. For this purpose, the 2-cm-wide prepreg strip protruding laterally over the chipboard is cut perpendicular to the edge of the board. The width of each strip and the distance between them is 12 mm.

At an angle of 60° from the chipboard, each protruding strip is peeled off by hand over a triangular bar with a sudden jerk. Peeling off takes place after lamination.

The area which is not covered or no longer completely covered by the prepreg after the peeling process is evaluated. The evaluation is based on grades (grade 1=very good to grade 6=unsatisfactory).

TESA Test

The TESA test is based on the IHD-W-463 works standard of the Institute of Wood Technology Dresden (IHD). To begin with, the laminated boards are stored for 24 hours. Thereafter, 15-cm-long TESA film strips (TESA film type 4104) are applied to the laminated board in and across the running direction of the laminating calendar and fixed bubble-free with a test roller (10 kg). After various intervals (immediately, 1 h, 2 h), the TESA film strip is peeled off by hand with a sudden jerk at an angle of 30° C. The area under the peeled test strip is evaluated. Ideally, the paper does not split. The evaluation of the TESA strength is based on grades (grade 1=very good to grade 6=unsatisfactory).

The test results in Table 1 show that the application of a hydrophobic coating of 0.1 to 10 g/m$^2$ (bd) onto the reverse of a formaldehyde-free prepreg leads to improved flatness (curling characteristics according to the Braun method and water value) in conjunction with good adhesion after bonding (adhesive strength and TESA test). A further increase in the quantity applied does not result in any further improvement in flatness and can lead to a deterioration in the adhesive properties.

TABLE 1

Composition of the impregnating resin solution and test results

| | Hydrophobic agent of the hydrophobic coating | | | | Flatness, curling | | | |
|---|---|---|---|---|---|---|---|---|
| | Wükoseal ® KIT % by weight, bd | Sitren ® 595 % by weight, bd | Hydrowax 215 % by weight, bd | Formaldehyde-free | characteristics according to the Braun method s | Flatness, water value s | Adhesive strength Grade | TESA test 2 h Grade |
| V-1 | | | | X | 1 | 8 | 2 | 3 |
| V-2 | | 1.5 | | X | 54 | 66 | 6 | 4 |
| V-3 | | | | | 31 | 34 | 2 | 2-3 |
| A-1 | 1.5 | | | X | 14 | 12 | 2-3 | 2 |
| A-2 | 1.0 | | | X | 13 | 11 | 2 | 2 |
| A-3 | 5.0 | | | X | 19 | 15 | 3 | 2 |
| A-4 | | | 1.5 | X | 10 | 11 | 3 | 3 |

The invention claimed is:

1. A prepreg comprising:

a decor base paper impregnated with a formaldehyde-free impregnating resin; and a hydrophobic coating configured to reduce water vapor permeability without impairing the ability of the prepreg to bond to a substrate;

wherein the prepreg has a decorative side and a reverse side opposite the decorative side, and wherein the hydrophobic coating is on the reverse side of the prepreg.

2. The prepreg according to claim 1, wherein a grammage of the hydrophobic coating is 0.1 g (bd)/$m^2$ to 10 g (bd)/$m^2$.

3. The prepreg according to claim 1, wherein the hydrophobic coating contains 20% to 100% by weight based on the total weight of the dry hydrophobic coating of an organic hydrophobic coating agent.

4. The prepreg according to claim 3, wherein the organic hydrophobic coating agent is a wax.

5. The prepreg according to claim 4, wherein the wax is a chemically modified natural wax, a fully synthetic wax, or any-mixture thereof.

6. The prepreg according to claim 1, wherein the content of the formaldehyde-free impregnating resin in the prepreg is 10% to 35% by weight, based on the grammage of the decor base paper.

7. The prepreg according to claim 1, wherein the formaldehyde-free impregnating resin is a mixture of a water-soluble polymer and a polymer latex.

8. The prepreg according to claim 7, wherein the water-soluble polymer is selected from starch, starch derivatives, or nanoscale starch particles.

9. The prepreg according to claim 7, wherein the water-soluble polymer is polyvinyl alcohol.

10. The prepreg according to claim 7, wherein the polymer latex is a styrene-acrylic acid ester copolymer.

11. The prepreg according to claim 7, wherein the ratio of water-soluble polymer/polymer latex in the impregnating resin solution is 80/20 to 20/80 relative to the weight of the impregnating resin (bd).

12. The prepreg according to claim 1, wherein the prepreg further comprises curling characteristics of at least 10 seconds according to the Braun method.

13. The prepreg according to claim 1, wherein the prepreg further comprises a water value of at least 10 seconds according to the method described herein.

14. A decorative film or decorative coating material containing a prepreg according to claim 1.

* * * * *